US012781412B2

(12) United States Patent
Sales

(10) Patent No.: US 12,781,412 B2
(45) Date of Patent: Nov. 3, 2026

(54) COMPARTMENTALIZED WASHER/DRYER TUB AND METHOD OF USE

(71) Applicant: Gregory Andrew Sales, Elizabeth, NJ (US)

(72) Inventor: Gregory Andrew Sales, Elizabeth, NJ (US)

( * ) Notice: Subject to any disclaimer, the term of this patent is extended or adjusted under 35 U.S.C. 154(b) by 2 days.

(21) Appl. No.: 18/062,294

(22) Filed: Dec. 6, 2022

(65) Prior Publication Data

US 2023/0096166 A1 Mar. 30, 2023

Related U.S. Application Data

(63) Continuation-in-part of application No. 16/906,793, filed on Jun. 19, 2020, now abandoned.

(51) Int. Cl.

| | |
|---|---|
| ***D06F 37/16*** | (2006.01) |
| ***D06F 39/12*** | (2006.01) |
| *D06F 37/08* | (2006.01) |

(52) U.S. Cl.

CPC ..... *D06F 37/16* (2013.01); *D06F 39/12* (2013.01); *D06F 37/08* (2013.01)

(58) Field of Classification Search

CPC ..... D06F 37/08; D06F 37/16; D06F 39/12
See application file for complete search history.

(56) References Cited

U.S. PATENT DOCUMENTS

| | | | | |
|---|---|---|---|---|
| 5,060,490 | A * | 10/1991 | Shaw | D06B 5/24 68/145 |
| 6,012,306 | A | 1/2000 | Raes | |
| 2006/0243002 | A1 | 11/2006 | Wunderlich | |
| 2013/0115130 | A1* | 5/2013 | Kappler | D06F 58/20 68/12.02 |
| 2021/0395934 | A1* | 12/2021 | Sales | D06F 58/20 |

FOREIGN PATENT DOCUMENTS

| | | | | |
|---|---|---|---|---|
| CN | 106958117 | A * | 7/2017 | D06F 17/10 |

OTHER PUBLICATIONS

CN106958117—Machine Translation (Year: 2017).*

* cited by examiner

*Primary Examiner* — Joseph L. Perrin
(74) *Attorney, Agent, or Firm* — James G. Passe; Passe Intellectual Property

(57) ABSTRACT

A tub for use in a washer or dryer that is dividable into compartments by use of a removable dividing wall. The removable dividing wall can be inserted manually or mechanically into position and held in place with a removable wall securing device. The tub has expanding and contracting capabilities that allows the diameter of the tub to be altered.

1 Claim, 2 Drawing Sheets

COMPARTMENTALIZED WASHER/DRYER TUB AND METHOD OF USE

This application is a continuation-in-part of U.S. non-provisional application Ser. No. 16/906,793 filed on Jun. 19, 2020, and which is incorporated herein in its entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a tub for use in a washer or dryer. In particular, it relates to a washer/dryer tub that is dividable into compartments that can be used to separate and wash or dry different types of fabrics or different colors.

Description of Related Art

The top-loading and front-loading washers and dryers typically have a rotatable drum or tub for holding clothes to be cleaned or dried. It is well known that it is important to separate clothing based on colors, fabrics, and the like and typically the only solution is to run multiple loads of laundry or to have multiple washers and dryers. In a commercial setting when there is a great deal of clothing to be cleaned, this setup is typically how it is handled. In a home situation, frequently the loads are small enough that purchasing and storing multiple washing machines is not practical.

One solution to the capacity problem for holding dirty laundry in a washer or dryer that has been utilized is an expandable tub which can be expanding or contracting in response to the volume of the tub and, thereby, the quantity of clothing that will fit in the tub. The expandable tub solution, however, does not fix the problem of washing and drying multiple different loads of laundry for the purpose of separating different fabrics and colors.

BRIEF SUMMARY OF THE INVENTION

The present invention relates to a system and method for dividing a washer or dryer tub to allow for separation of fabrics or colors while washing or drying them congruently.

Accordingly, in one embodiment, there is a system for separating clothes in a washer or dryer tub comprising:

a) a removable dividing wall of a length that can divide the washer and dryer tub in half when removably inserted along the tub's diameter;
b) one or more adjustable position flaps attached to the dividing wall that can further divide the washer or dryer tub;
c) a washer or dryer tub having a device for expanding or contracting the diameter of the washer or dryer tub; and
d) a device for removably securing the dividing wall in place.

In another embodiment, there is a method for separating clothes in a washer or dryer tub comprising:

a) selecting a washer or dryer tub comprising:

i. a removable dividing wall of a length that can divide the washer and dryer tub in half when removably inserted along the tub's diameter;
ii. a washer or dryer tub having a device for expanding or contracting the diameter of the washer or dryer tub;
iii. a device for removably securing the dividing wall in place; and
iv. one or more adjustable position flaps attached to the dividing wall that can further divide the washer or dryer tub;

b) inserting the dividing wall into the washer or dryer tub; and
c) inserting clothing in the compartments created by the dividing wall.

DETAILED DESCRIPTION OF THE INVENTION

Figure 1:
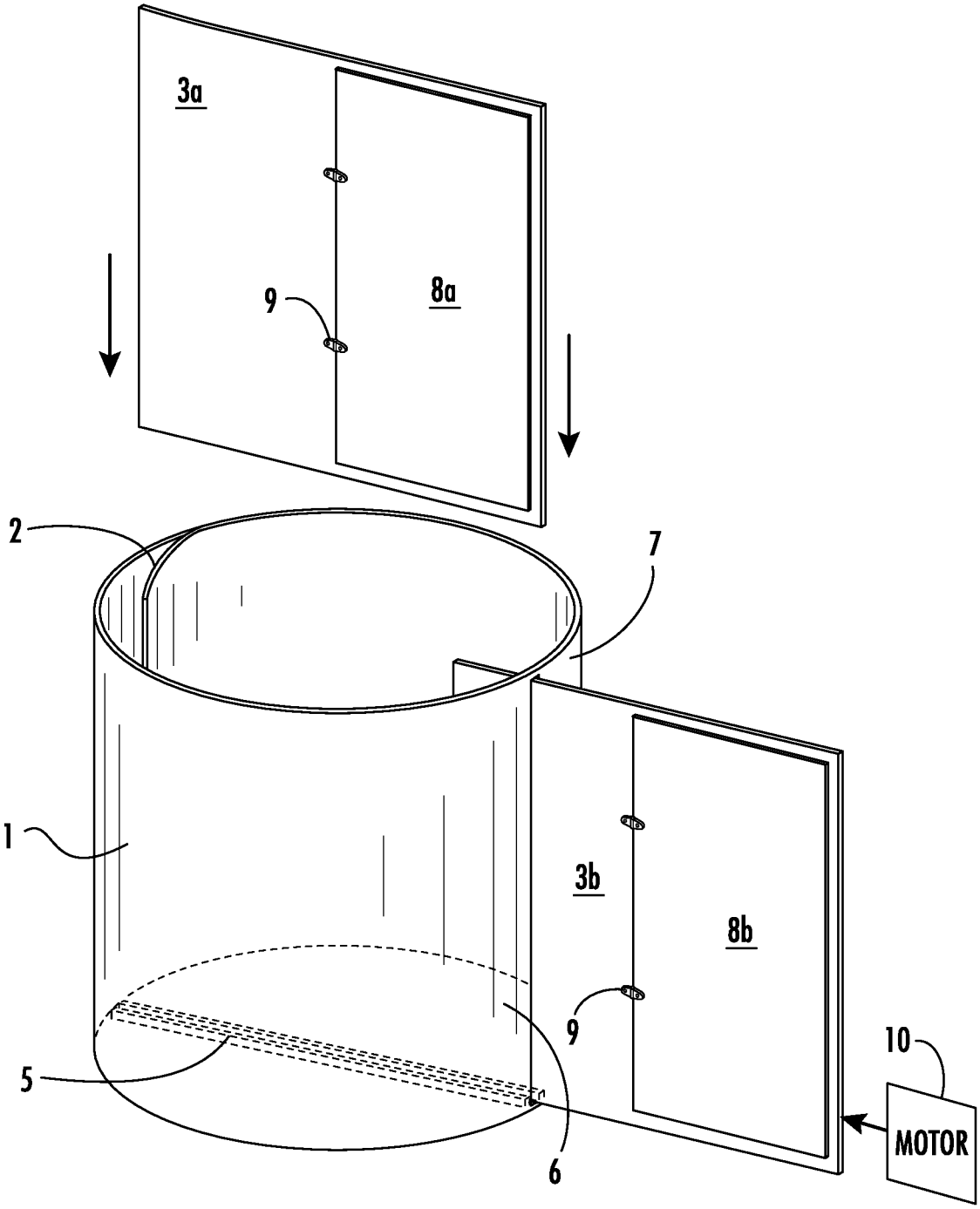
FIG. 1 is a partially exploded view of the system of the present invention.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "separating clothes" refers to dividing the washer or dryer clothing load into different loads that need to be separated (e.g., by color, material, or the like), such as separating whites from darks.

As used herein, the term "washer or dryer tub" refers to the washing machine or clothes dryer basket or drum that is the part of the washer or dryer that holds the clothes and rotates to wash or dry them. They can be plastic, porcelain or stainless steel.

As used herein, the term "removable dividing wall" refers to a wall inside the washer or dryer tub that divides the tub in two, generally along a diameter of the washer or dryer tub. The wall is addable or removable from the tub either manually or mechanically (hands free insertion). The dividing wall can be inserted from the top of an upright tub or from the front of a washer or dryer that lies on its side (as are most commercial washers and dryers). The dividing wall can also be inserted from the sidewall of the washer or dryer tub as shown in the Figures. The dividing wall can be inserted manually by placing it in position in the washer or dryer tub. To mechanically insert the dividing wall, a motor or similar device powers the dividing wall from a starting position in the washer or dryer to the desired position inside the tub. This can be constructed to be activated from the washing machine or dryer, and in one embodiment, there is a remote to activate movement of the dividing wall. This is especially advantageous when inserting the dividing wall through the sidewall of the washer or dryer tub. The dividing wall can be made of any material suitable for use in a washer or dryer, such as plastics and metal dividers.

As used herein, the term "device for removably securing the dividing wall in place" refers to a device for holding and securing in place the dividing wall during use of the washer or dryer. This prevents movement of the dividing wall during use of the washer or dryer. It can be held in place with clips, locks, gripping devices, and the like, as needed. Selection is within the skill of the art, in view of the disclosure herein.

As used herein, the term "insertion from a top" refers to placing the dividing wall in the washer or dryer tub when the tub opening is on the top of the washer or dryer (e.g., commonly called "top loaders").

As used herein, the term "sidewall of the tub" refers to the sides of a washer or dryer tub. The sidewall can be expandable or fixed in diameter to increase or decrease the load chamber of the washer or dryer tub.

As used herein, the term "manual insertion" refers to inserting and removing the dividing wall in the washer or dryer tub by hand.

As used herein, the term "hands free insertion" refers to a mechanical insertion and removal of the dividing wall.

As used herein, the term "adjustable position flaps" refers to one or more flaps (as shown in the Figures), which are hingedly attached on the dividing wall. The away position is up against the dividing wall, which means the flap is not in use. If it is swung away from the dividing wall, it creates one or more extra compartments. The flap is of a length that, when swung open, it meets the inner sidewall of the washer or dryer tub.

DRAWINGS

Now referring to the drawings, FIG. 1 is a partially exploded view of the system of the present invention. Washer or dryer tub 1 has an expandable feature 2 that allows the diameter of the tub to be altered. FIG. 1 depicts a top opening tub, but the drawings apply to where the opening is perpendicular to the drawing (e.g., a front loading washer or dryer). Removable dividing wall 3*a* can be manually inserted in tub 1 to divide the tub into two compartments. Removable wall securing device 5 is positioned to removably secure the removable dividing wall 3*a* or 3*b* during use. In another embodiment, dividing wall 3*b* is designed to enter tub 1 through a hole 6 in the sidewall 7 of the tub 1 and secure in place in the removable wall securing device 5. The removable dividing wall 3*a* or 3*b* can be inserted manually, but, in one embodiment, a motor 10 (via remote or the controls on the washer or dryer) pushes or drops the removable dividing wall 3*a* or 3*b* in place in the removable wall securing device 5.

Each removable dividing wall 3*a* and 3*b* has flap 8*a* or 8*b* (or could be a plurality of flaps), which has hinges 9 that allow each flap to either remain against the removable dividing wall 3*a* or 3*b* or be moved to an open position, which then further divides the tub 1.

Figure 2:
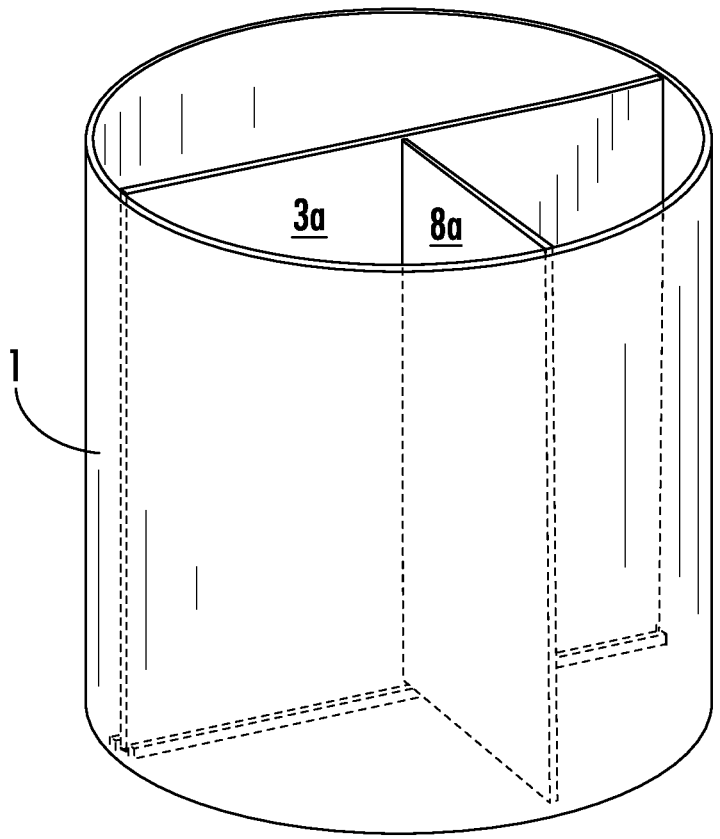
FIG. 2 is a perspective view of the present invention with the dividing walls.

FIG. 2 shows the tub 1 with the removable dividing wall 3*a* in place and flap 8*a* positioned in the open position creating 3 compartments.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A method for separating clothes in a washer or dryer tub consisting of:

a) selecting the washer or dryer tub comprising:

i. a removable dividing wall of a length that can divide the washer or dryer tub in half by mechanical insertion of the dividing wall in the washer or dryer tub;

ii. the washer or dryer tub having a device for expanding or contracting the diameter of the washer or dryer tub;

iii. a device for removably securing the dividing wall in place; and iv. one or more adjustable position dividing wall flaps attached to the dividing wall that when used, the one or more adjustable position dividing wall flaps are positioned to prevent movement of the one or more adjustable position dividing wall flaps during use to further divide the washer or dryer tub into a plurality of fixed size compartments;

b) mechanically inserting the dividing wall into the washer or dryer tub using a motor and engaging the one or more adjustable position dividing wall flaps to create the plurality of fixed sized compartments; and c) inserting clothing in each of the plurality of fixed sized compartments created by the dividing wall and the one or more adjustable position dividing wall flaps.

* * * * *